US006167600B1

(12) United States Patent
Williams et al.

(10) Patent No.: US 6,167,600 B1
(45) Date of Patent: Jan. 2, 2001

(54) COLUMBARIUM SYSTEM

(75) Inventors: Kevin C. Williams, Brooklyn, NY (US); Frank Williams, Lewisville, NC (US)

(73) Assignee: Everest Columbarium, Lewisville, NC (US)

( * ) Notice: Under 35 U.S.C. 154(b), the term of this patent shall be extended for 0 days.

(21) Appl. No.: 09/240,353

(22) Filed: Jan. 29, 1999

(51) Int. Cl.[7] ..... A61G 17/00
(52) U.S. Cl. ..... 27/1; 27/35; 52/128; 52/136
(58) Field of Search ..... 27/1, 35; 52/128, 52/133, 134, 136, 139; 206/503, 504, 508; 220/4.26, 4.27

(56) References Cited

U.S. PATENT DOCUMENTS

| | | | |
|---|---|---|---|
| 3,081,023 | | 3/1963 | Taylor . |
| 3,183,574 | | 5/1965 | Diem . |
| 3,446,394 | * | 5/1969 | Miller et al. . |
| 3,529,730 | | 9/1970 | Thompson . |
| 3,754,805 | | 8/1973 | Pangburn et al. . |
| 3,815,281 | * | 6/1974 | Kander . |
| 3,841,726 | | 10/1974 | Andros et al. . |
| 3,990,198 | | 11/1976 | Ortutay . |
| 3,997,072 | * | 12/1976 | Guth . |
| 4,073,100 | * | 2/1978 | DiGiovanni, Jr. . |
| 4,170,082 | * | 10/1979 | Freedman . |
| 4,607,417 | * | 8/1986 | Hancovsky . |
| 4,614,066 | | 9/1986 | Koppenberg . |
| 5,195,812 | | 3/1993 | Eickhof . |
| 5,287,603 | | 2/1994 | Schorman . |
| 5,477,594 | | 12/1995 | LePage ..... 27/1 |
| 5,896,993 | * | 4/1999 | Nask et al. . |

OTHER PUBLICATIONS

Armento Liturgical Arts, Inc.'s Design Spreadsheet for Columbariums: Date of Publication: before Feb. 4, 1997; Place of Publication: United States.

Page 36 of "The American Cemetery for Jul. 1996" showing the Eickof "Flexi–Niche" columbarium; Date of Publication: before Feb. 4, 1997; Place of Publication United States.

* cited by examiner

*Primary Examiner*—B. Dayoan
*Assistant Examiner*—William L. Miller
(74) *Attorney, Agent, or Firm*—Hoffmann & Baron, LLP

(57) ABSTRACT

A columbarium system for the storage of human remains that includes a plurality of similarly configured storage containers is disclosed. The storage container has walls that define an enclosure having an opening at one end with a mounting plate attached thereto. The mounting plate has a pair of tabs that are arranged on opposite sides of the mounting plate and one pair of receiving grooves arranged at opposite sides of the mounting plate. The receiving grooves are dimensioned for receiving a tab from another container so that an arrangement of containers can be formed by the interlocking engagement of the tabs and grooves in adjacently arranged containers. The storage containers are self-framing in that additional framing members are not required for the erection of the columbarium system.

22 Claims, 7 Drawing Sheets

COLUMBARIUM SYSTEM

BACKGROUND OF THE INVENTION

1. Field of the Invention

The present invention relates generally to a columbarium system, and specifically relates to a storage container that can be used for erecting the columbarium system without the need for erecting a separate framework to support each storage container.

2. Description of the Prior Art

Columbarium systems are known in the art. A columbarium system or urn storage system provides for long term storage of cremated human remains. Columbariums are generally erected either in an exterior environment or within the confines of a building. It is therefore generally preferred to have a columbarium system that is designed to withstand external wind pressures and be weather tight. Various columbarium systems consisting of a plurality of framing members are known. Included among these systems are those shown in U.S. Pat. Nos. 3,183,574 to Diem, 3,529,730 to Thompson, 3,754,805 to Pangburn et al., 3,841,726 to Andros et al., 4,614,066 to Koppenberg, 5,195,812 to Eickhof and 5,477,594 to LePage.

U.S. Pat. No. 3,183,574 to Diem discloses an urn and frame construction comprising various shaped horizontal bars and urn support members vertically separated by spacer elements. The frame is designed to accommodate a specially constructed urn having a generally hexagonal cross-section shape.

U.S. Pat. No. 3,529,730 to Thompson discloses a repository for cremated remains having a plurality of storage tube members arrayed and supported in a close generally parallel side-by-side and top-to-bottom relationship with a plurality of individual hollow urn containers. In one embodiment the plurality of storage tubes are supported by a frame consisting of horizontal and vertical frame members. In another embodiment a honey comb arrangement provides for the storage space for the urns.

U.S. Pat. No. 3,754,805 to Pangburn et al. discloses an urn storage assembly having a plurality of tubular storage members of generally rectangular cross-section, each member being shaped to receive cremated remain storage urns. The storage members are nested in abutting side-by-side and top-to-bottom relationship to one another. The storage members are held together by securing means which engage the end corner portions of adjacent storage members.

U.S. Pat. No. 3,841,726 to Andros et al. discloses an urn storage assembly having a plurality of storage units in a generally rectangular array. Each storage unit has a generally rectangular cross-section. The assembly has a lattice-like framework comprising a plurality of intersecting, rigidly interconnected horizontal and vertical members, with each member being adapted to engage and receive the wall portions of the storage unit whereby the lattice-like framework forms a facial array for the storage assembly. The vertical and horizontal members are disposed along the plane defined by the outer edge of the wall portions.

U.S. Pat. No. 4,614,066 to Koppenberg discloses a modular columbarium structure made from a plurality of preformed modular units. The units are secured together utilizing brackets spanning coplanar walls of adjacent units, channel members of overlying parallel and adjacent front edges in units, and rosettes secured to the brackets and overlying ends of the channel members.

U.S. Pat. No. 5,195,812 to Eickhof discloses a columbarium that is a framework. The framework uses planar risers having brackets to support lightweight shelving.

U.S. Pat. No. 5,477,594 to LePage discloses an urn storage assembly for the internment of cremated remains. The storage assembly comprises a plurality of similar panel members that can be used for the top, bottom and side surfaces of niches formed therein. A corner connector is provided for holding the panels that are arranged perpendicularly together.

U.S. Pat. No. 5,287,603 to Schorman discloses a storage container for human remains consisting essentially of a box and a lid, with the lid being held in place by a retaining ring. The exterior portion of the container has mating surfaces that allow a plurality of storage containers to be stacked together into an assemblage. The disclosure, however, does not provide for connecting the individual storage containers together, and therefore the stacked system of storage containers would be unable to withstand the wind pressures expected in a columbarium system that is erected outside and exposed to the elements.

All of the known columbarium or urn storage structures exemplified by those described above are undesirable because they are expensive to construct, and are unduly complex in their construction. It would be advantageous to provide a columbarium system which did not require a frame work, which is easy to construct and made from modular members which could create a number of different shaped systems, e.g. a cross or other configuration.

OBJECTS AND SUMMARY OF THE INVENTION

It is an object of the present invention to provide a modular storage container for use in a flexible columbarium system.

It is a further object of the present invention to provide a storage container that is relatively inexpensive and easy to manufacture.

It is another object of the present invention to provide a columbarium system that is easily erected without the use of a framework regardless of the configuration.

It is yet another object of the present invention to provide a columbarium system that can withstand external wind pressures without the use of a separate framework.

In accordance with one form of the present invention, a storage container for human remains includes walls that define an enclosure having an opening at one end and defining a rim therearound. The storage container has a mounting plate that is mechanically connected to the rim of the enclosure. The mounting plate includes at least one pair of tabs which are arranged at opposite side of the mounting plate. The mounting plate also has at least one pair of receiving grooves dimensioned for receiving a tab therein. Preferably, the mounting plate is shaped to form a polygon having an even number of sides. The receiving grooves are arranged at opposite sides of the mounting plate so that an arrangement of containers can be formed by the interlocking engagement of tabs and grooves when the containers are adjacently arranged. The enclosure can have a cross section that is either circular, ovular, triangular, rectangular, or polygonal.

In another form of the present invention, a storage container for human remains that is configured to allow a plurality of containers to be connected to form an arrangement includes a first mounting plate, a second mounting plate, and a tube. The first and second mounting plates have a perimeter, a thickness and opposite inner and outer surfaces. Preferably, the mounting plates are shaped to form either a triangle, rectangle, or polygon. The perimeter and thickness of the first mounting plate define a first mating surface, and the perimeter and thickness of the second mounting plate define a second mating surface. The tube has opposite first and second axial ends, a longitudinal axis and a perimeter that defines a bore having a cross-section. The tube is attached at the first axial end to the inner surface of the first mounting plate and is attached at the second axial end to the inner surface of the second mounting plate. An opening that is in communication with the bore is formed in at least one of the first mounting plate and the second mounting plate. The opening allows the cremated remains to be placed within the bore. The first mating surface and the second mating surface are configured to allow a plurality of containers to be connected at the first mating surface and the second mating surface to form an arrangement. Preferably, the inner surface of the first mounting plate is substantially orthogonally aligned with the longitudinal axis of the tube.

In preferred embodiments of both forms of the invention identified above, the cross-section can be either circular, ovular, triangular, rectangular, or polygonal. The storage container may also include a plug configured to removably enclose the opening as well as a face plate for attachment to a mounting plate to cover the opening.

In a preferred embodiment that includes the first and second mounting plates, the first mounting plate may be shaped in the form of a rectangle wherein the first mating surface has first and second sides formed with a tab and third and fourth sides formed with a groove for receiving a tab from another container in a mating relationship. Preferably, the perimeter of the second mounting plate is also in the form of a rectangle with the second mating surface having first and second sides formed with a tab and third and fourth sides formed with a groove for receiving a tab from another container in the mating relationship.

In accordance with the present invention, a columbarium for the storage of human remains includes a plurality of storage containers configured in an arrangement. The storage containers can be in the form of the storage containers described above. Alternatively, the storage container can also include a tubular member that defines a receiving space therein. The container has a first mounting plate and a second mounting plate coupled respectively to a first end and second end of the tubular member. The mounting plates have a plurality of sides with at least one of the sides including a first engagement member and at least one of the sides including a second engagement member. The first engagement member and the second engagement member cooperate to mechanically connect adjacently arranged containers such that one container can support the adjacently arranged container in a number of configurations. Preferably, the first engagement member is at least one projecting tab and the second engagement member is at least one groove dimensioned for receiving the tab. The columbarium can include fasteners for mechanically connecting the tab to a groove. In another form of the present invention, the first and second mounting plates both have four sides such that a pair of opposite sides include projecting tabs and the other pair of opposite sides include grooves.

A method of erecting the columbarium includes the steps of:

(a) providing a plurality of storage containers;

(b) connecting the plurality of containers together to form an arrangement; and (c) mounting the arrangement to a support structure.

In erecting the columbarium, the containers may be connected together by applying glue to the tabs, or by installing mechanical fasteners through the mounting plate at the tab to connect the tab to another container.

A preferred form of the columbarium storage container and system of the present invention, as well as other embodiments, objects, features and advantages of this invention, will be apparent from the following detailed description of illustrative embodiments thereof, which is to be read in connection with the accompanying drawings.

DETAILED DESCRIPTION OF THE PREFERRED EMBODIMENTS

Figure 1:
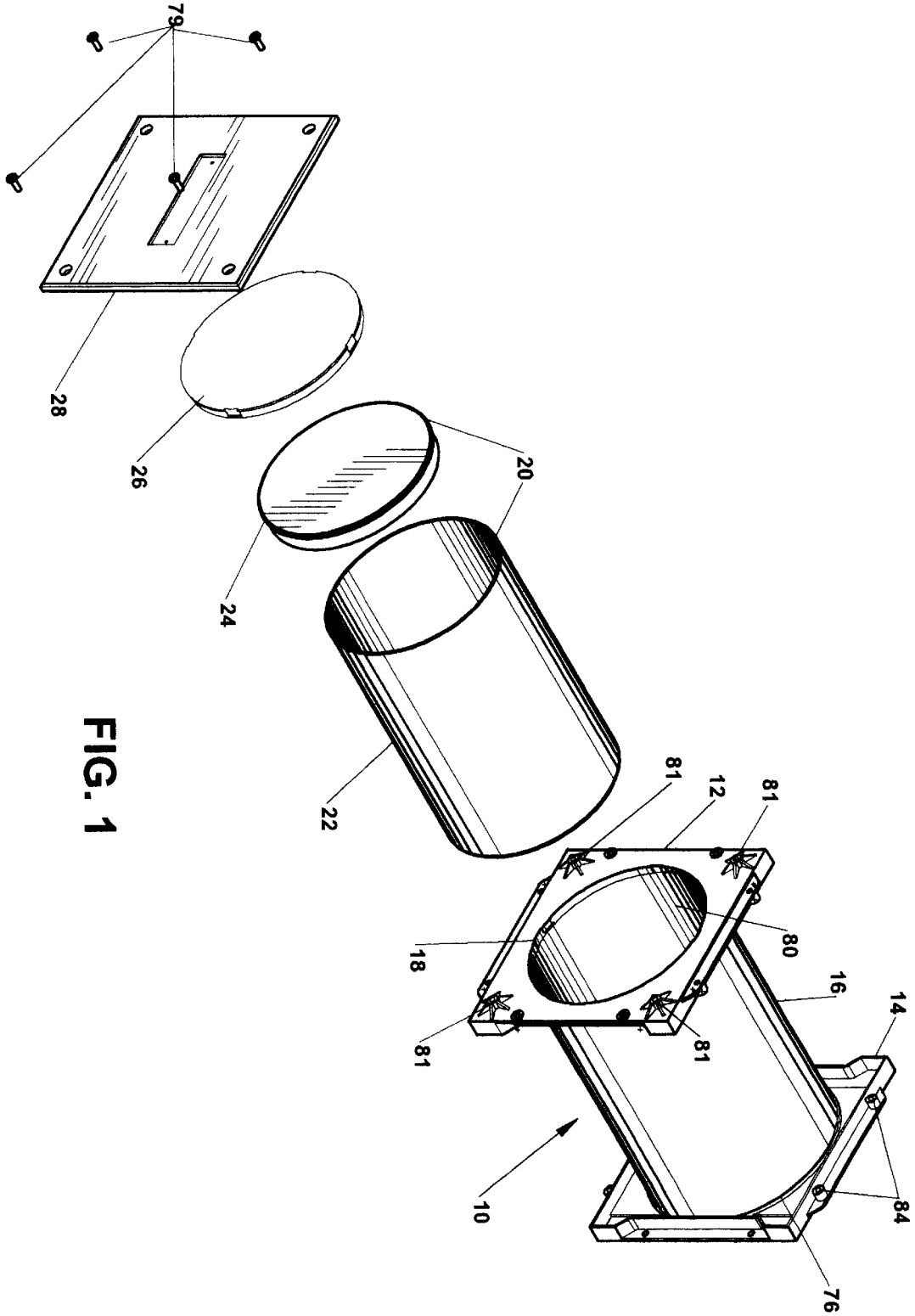
FIG. 1 is an exploded perspective view of a storage container according to the present invention with an urn to be stored therein.
Figure 5:
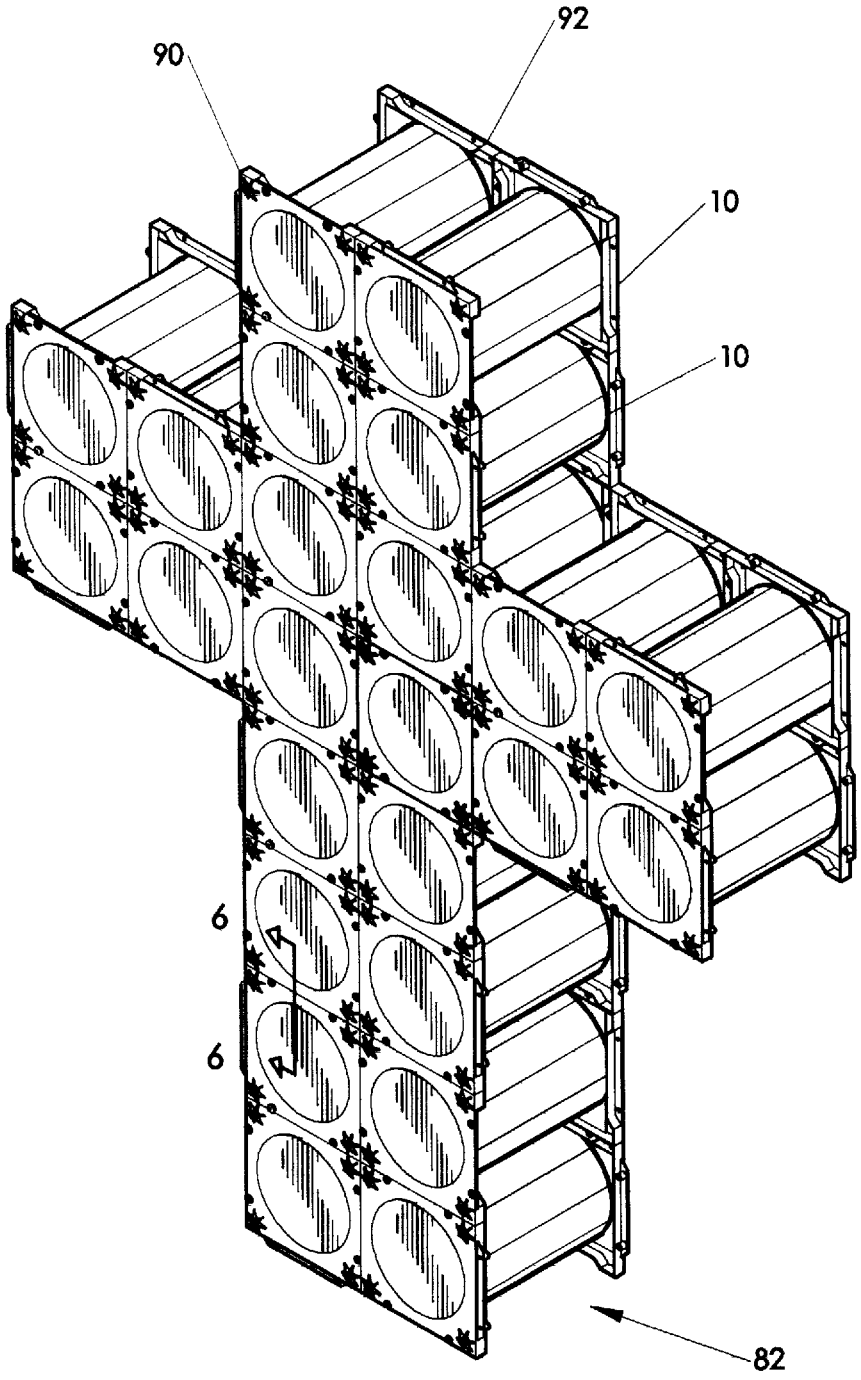
FIG. 5 is a perspective view of a columbarium system erected from storage containers according to the present invention.

Referring to FIG. 1, the storage container 10 in accordance with the present invention generally includes a first mounting plate 12, a second mounting plate 14, and a tube 16. The first mounting plate 12 is generally formed with an opening 18 to allow human remains to be placed within the tube 16. As shown in FIG. 1, the human remains (not shown) may be placed in an urn 20 having a bottom portion 22 and a top 24 prior to placement within the tube 16. Once the urn 20 is placed inside the tube 16, the storage container 10 is preferably sealed with a plug 26 that is configured to removably enclose the opening 18 within the first mounting plate 12. A face plate 28 may also be attached to either the first mounting plate 12 or the second mounting plate 14. As shown in FIG. 5, the storage containers 10 are of a modular construction which facilitates the erection of columbarium systems without the need for additional support members or a separate framework as disclosed in the prior art. The storage containers 10 are self-framing providing for the erection of columbarium systems in a variety of configurations, including those that frame around openings and have cantilevered sections extending from them.

Figure 2A:
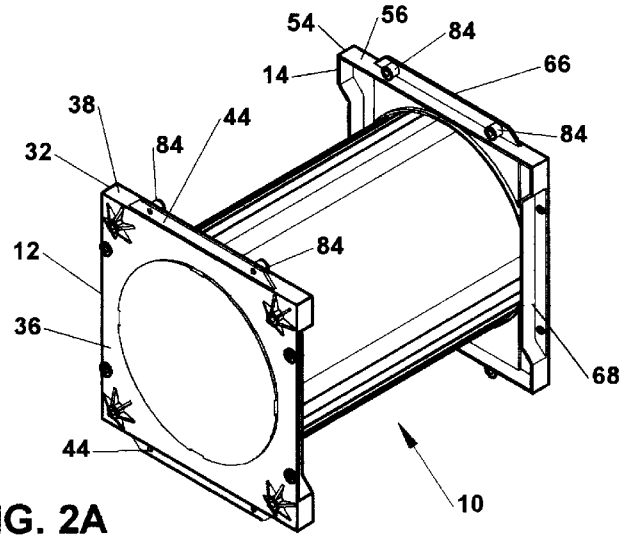
FIG. 2A is a perspective view of the storage container according to the present invention.
Figure 2C:
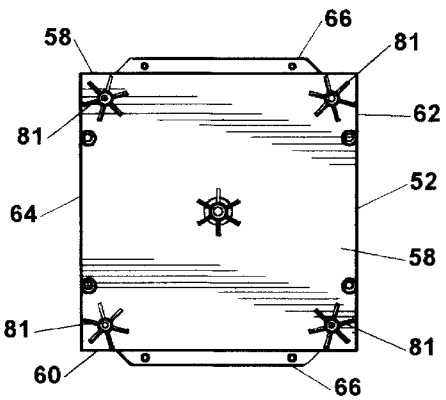
FIG. 2C is a rear elevational view of the storage container.
Figure 2E:
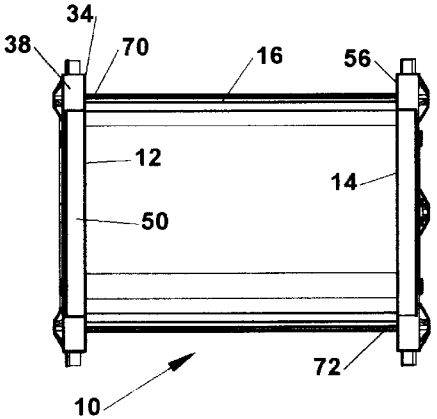
FIG. 2E is a side elevational view of the storage container illustrating grooves on the mounting plates.
Figure 2D:
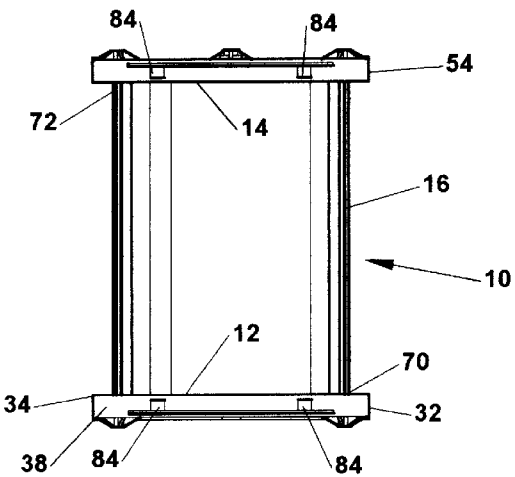
FIG. 2D is a side elevational view of the storage container illustrating tabs on the mounting plates.
Figure 2B:
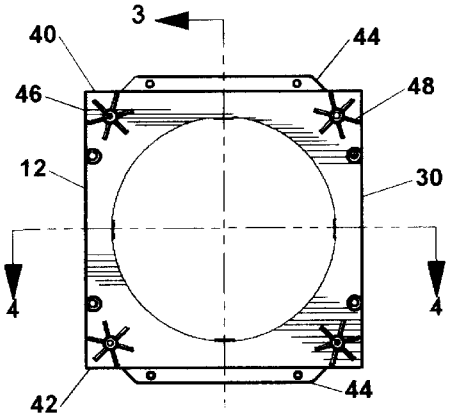
FIG. 2B is a front elevational view of the storage container.
Figure 3:
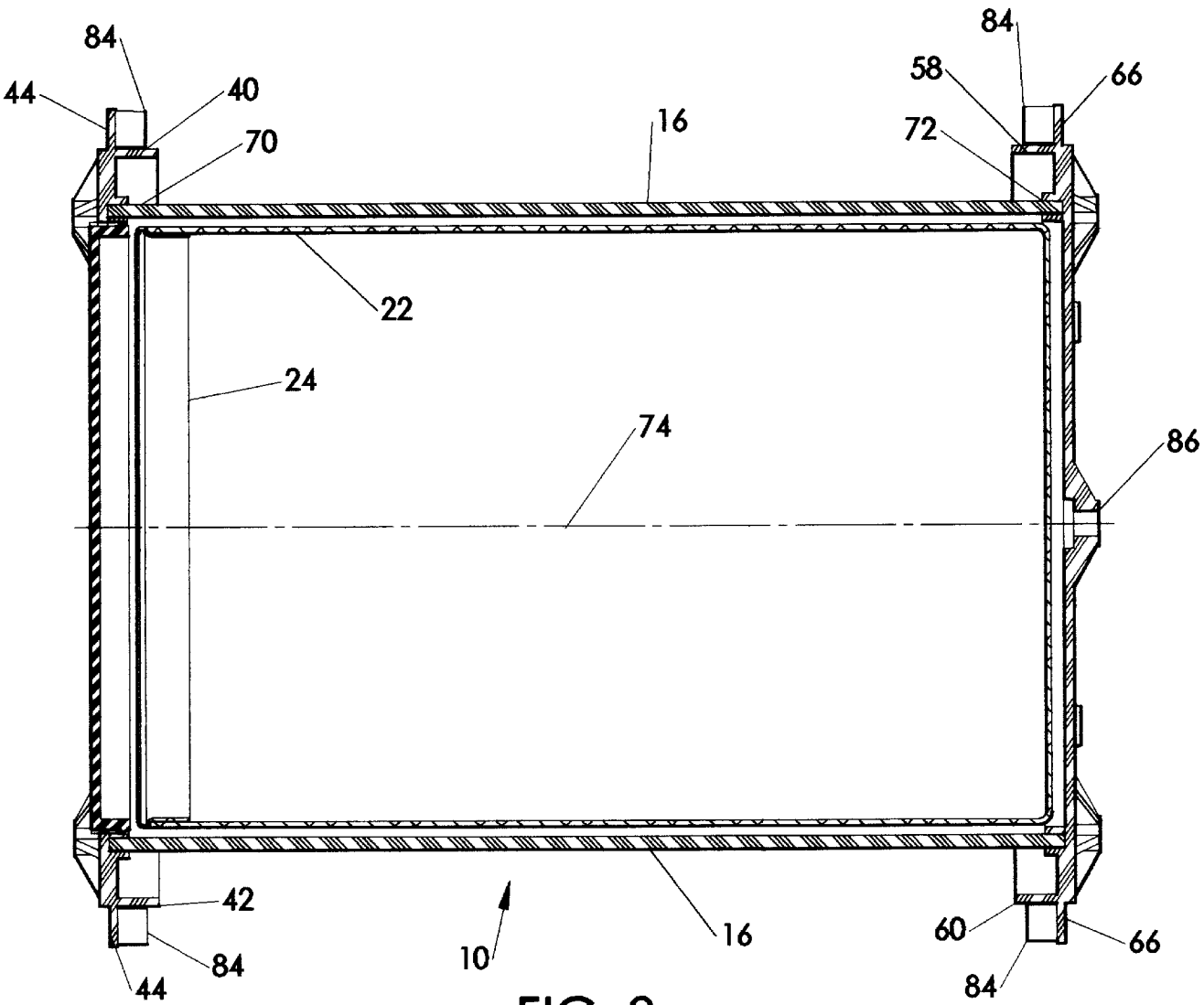
FIG. 3 is a sectional view taken along line 3—3 of the storage container as shown in FIG. 2B with an urn stored therein and a plug installed in the opening of the mounting plate.
Figure 4:
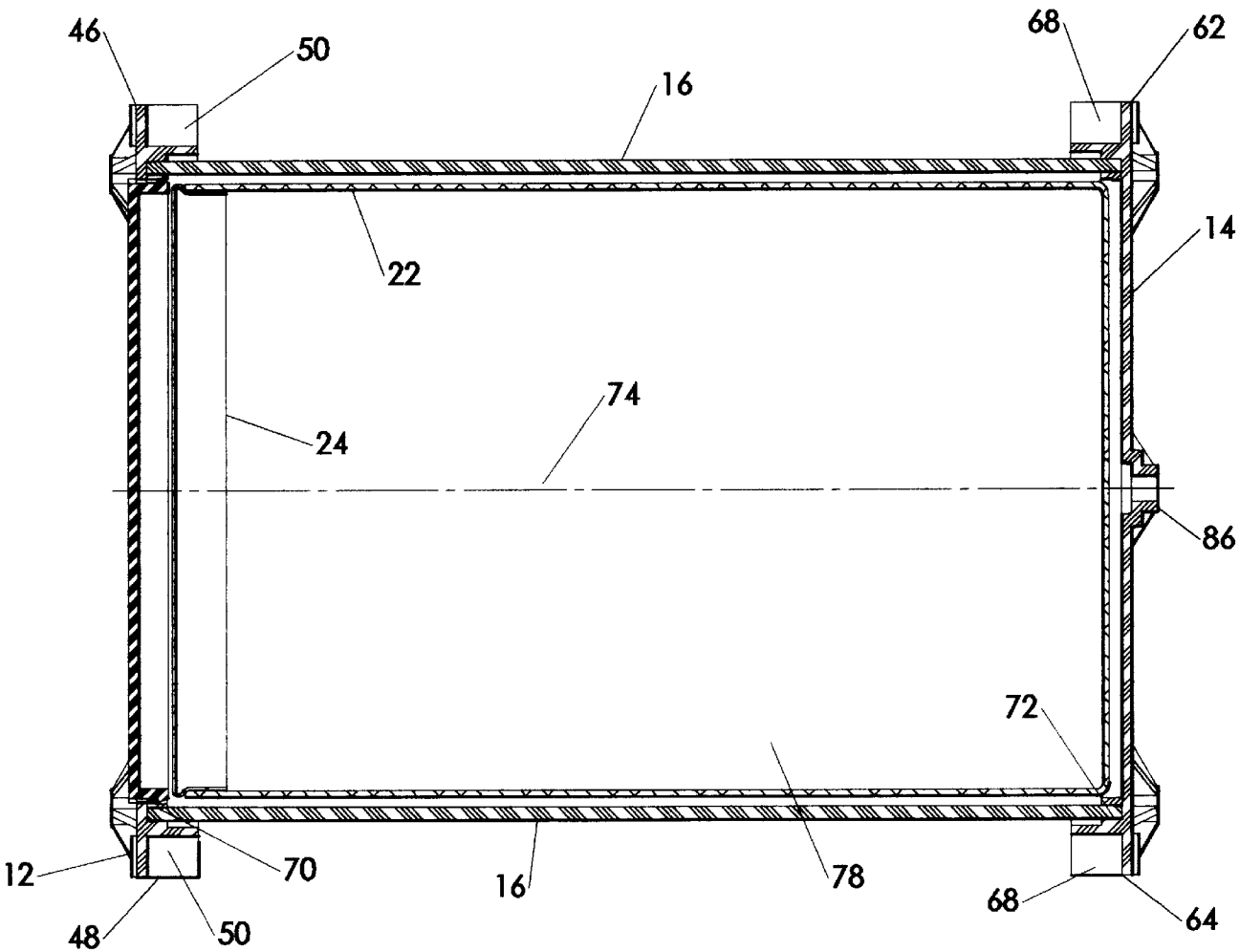
FIG. 4 is a sectional view taken along line 4—4 of the storage container as shown in FIG. 2B with an urn stored therein and a plug installed in the opening of the mounting plate.
Figure 6:
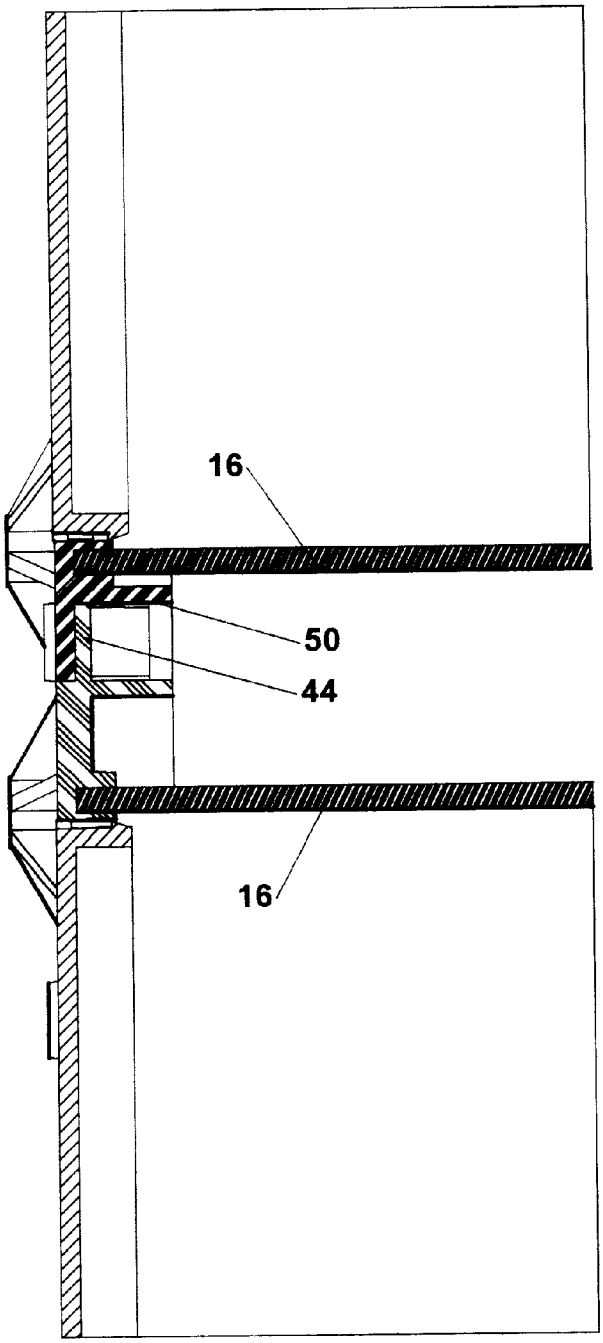
FIG. 6 is a sectional view taken along line 6—6 of the columbarium system as shown in FIG. 5.

Referring now to FIGS. 2A, 2B and 2E, the first mounting plate 12 has a perimeter 30, a thickness 32 and opposite inner and outer surfaces 34, 36. The perimeter 30 and thickness 32 define a first mating surface 38. The perimeter 30 may be shaped in a wide variety of forms, including a circle, triangle, rectangle, and polygon. Preferably, the perimeter 30 is shaped to form a rectangle with the first mating surface 38 having first and second sides 40, 42 each including a projecting tab 44 and third and fourth sides 46, 48 each formed with a groove 50. In one embodiment of the invention that is shown in FIGS. 2B, 3, and 4, the first and second sides 40, 42 are on opposite sides, and the third and fourth sides 46, 48 are also on opposite sides. That is, the tabs 44 and grooves 50 are each arranged on opposite sides of the first mounting plate 12 as shown in FIG. 2B. In an alternative embodiment (not shown), the first and second sides 40, 42 intersect to form a corner of the rectangular shaped perimeter 30. Each groove 50 is configured to receive a tab 44 from another storage container 10 in a mating relationship as shown in FIG. 6.

Referring now to FIG. 2C, the second mounting plate 14 is similar to the first mounting plate 12 in that it has a perimeter 52, a thickness 54 and opposite inner and outer surfaces 56, 58. Likewise, the perimeter 52 and the thickness 54 define a second mating surface 56. The perimeter 52 of the second mounting plate 14 may also be shaped to form a rectangle so that the second mating surface 56 has first, second, third and fourth sides 58, 60, 62, 64. The second mounting plate 14 is also preferably formed with a tab 66 on the first and second sides 58, 60 and a groove 68 for receiving a tab 66 from another storage container 10 in a mating relationship on the third and fourth sides 62, 64.

Referring now to FIGS. 2E, 2D, 3 and 4, the tube 16 has opposite first and second axial ends 70, 72, a longitudinal axis 74 and a perimeter 76 defining a bore 78 having a cross-section 80. The tube 16 is attached at the first axial end 70 to the inner surface 34 of the first mounting plate 12 and is attached at the second axial end 72 to the inner surface 56 of the second mounting plate 14. The walls of the tube 16 and a portion of the second mounting plate 14 form an enclosure for generally holding a container of human remains. Preferably, the tube 16 is attached to the first and second mounting plates 12, 14 so that the inner surfaces 34, 56 of the mounting plates 12, 14 are substantially orthogonally aligned with the longitudinal axis 74 of the tube 16. The cross-section 80 is preferably configured to receive a commercially available urn 20 as shown in FIGS. 1, 3, and 4. The cross-section 80 can be circular, ovular, triangular, rectangular, or polygonal.

The storage container 10 can be made from a wide variety of materials. Preferably the storage container 10 is injected molded as one integral piece from a thermoplastic. Alternatively, the storage container 10 can be fabricated in separate parts—mounting plates and tube—and subsequently fastened together. As shown in FIGS. 1, 3, and 4, the thickness of the mounting plates can be varied to include hollowed portions to reduce the quantity of materials used and the associated costs. The plug 26 is also preferably made from a thermoplastic.

The face plate 28 is traditionally fabricated from an ornamental material such as bronze or stone and generally includes the name of the person whose cremated remains are stored in the container 10. The face plate 28 may be mechanically fastened to either the first mounting plate 12 or the second mounting plate 14 with machine screws 79 as shown in FIG. 1. Preferably, the first and second mounting plates 12, 14 are formed with threaded inserts 81 for receiving the machine screws 79.

A columbarium 82 for the storage of human remains can be assembled by connecting a plurality of the storage containers 10 as described above together to form an arrangement. An example of an arrangement is shown in FIG. 5. The arrangement can then be mounted to a support structure.

In assembling the arrangement, the storage containers 10 are mechanically connected together by either using an adhesive or by installing mechanical fasteners at the perimeters 30, 52 of the mounting plates 12, 14 to connect the tabs 44, 66 of the mounting plates 12, 14 to the mounting plates 12, 14 of the adjacently aligned storage container 10. As shown in FIGS. 2A and 6, the tabs 44, 66 can be provided with threaded inserts 84 for engaging a screw for making the mechanical connection. The mechanical connection allows an arrangement to be assembled in a variety of forms including those depicted in the Armento Liturgical Arts, Inc.,'s "Design Spreadsheet," whose place of business is 1011 Military Road, Buffalo, N.Y. The mechanical connection is particularly advantageous in that the storage containers 10 are self-framing. That is, the storage containers 10 do not require any additional frame members as required by the prior art to form openings within an arrangement or to have cantilevered portions, as shown in FIG. 5, extending therefrom.

Figure 7:
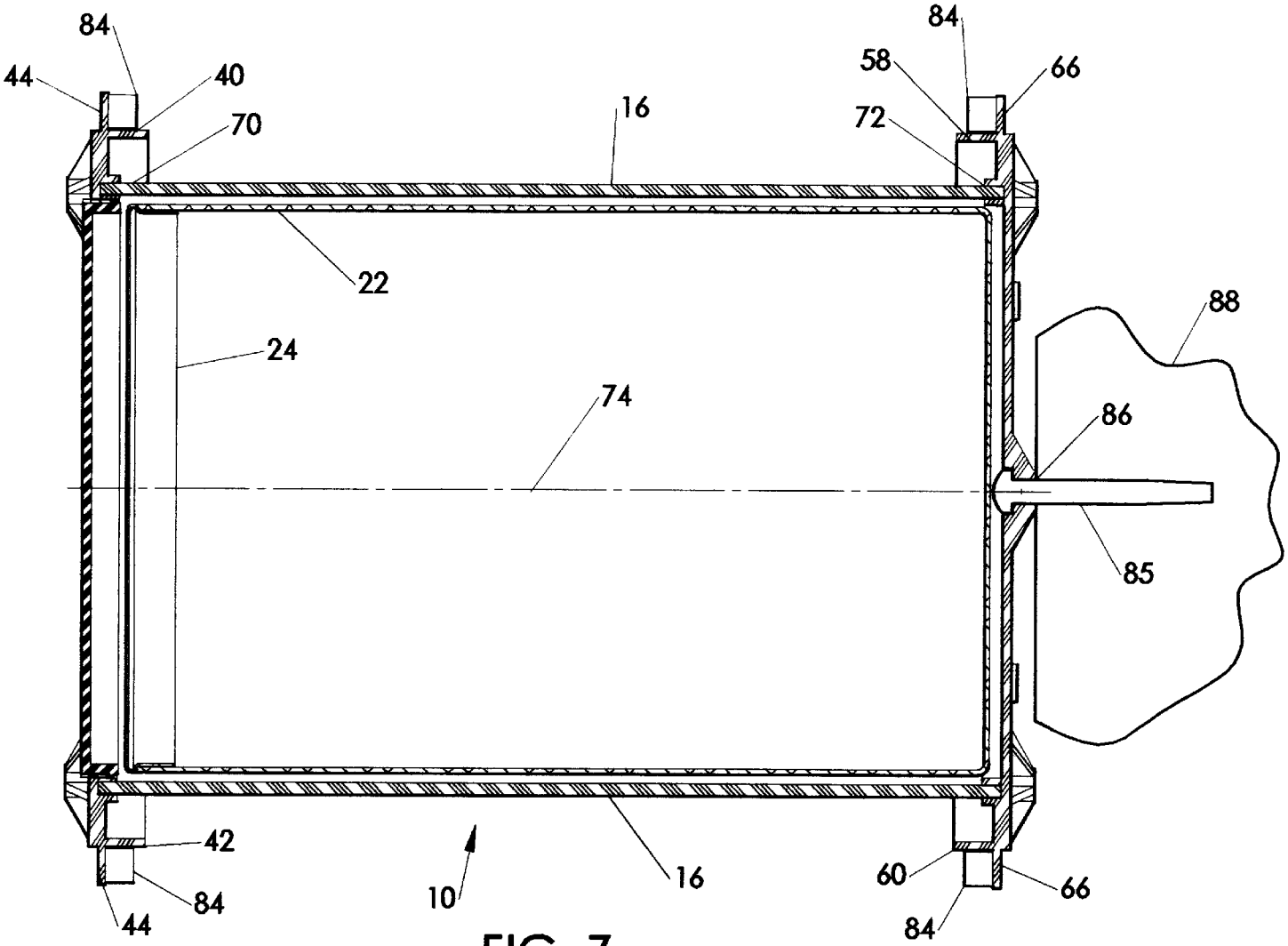
FIG. 7 is a sectional view similar to FIG. 3 showing the storage container attached to a support structure.

In mounting the arrangement to a support structure 88, the arrangement is generally attached to the support structure 88 at both the top and bottom with tie-back anchors 85 such as bolts, screws, and the like as shown in FIG. 7. To facilitate this installation the second mounting plates 14 are generally formed with a hole 86 for accommodating the tie-back anchors 85. These tie-back requirements are held to a minimum because the mounting plates 12, 14 behave structurally as an integrally formed wall having a first wall 90 and a second wall 92 due to their mechanical connection as shown in FIG. 5. The spacing of the tie-back anchors 85 will depend upon the expected wind loading and the strength of the materials selected for forming the storage containers 10.

Although illustrative embodiments of the present invention have been described herein with reference to the accompanying drawings, it is to be understood that the invention is not limited to those precise embodiments, and that various other changes and modifications may be effected by one skilled in the art without departing from the scope or spirit of the invention.

What is claimed is:

1. A modular storage container for human remains configured to allow a plurality of the containers to be connected to form an arrangement, said container comprising:

walls defining an enclosure having an opening at one end and defining a rim therearound;

a mounting plate mechanically connected to the rim of the enclosure, said mounting plate including at least one pair of tabs which are arranged at opposite sides of said mounting plate and at least one pair of receiving grooves dimensioned for receiving a tab therein, said receiving grooves being arranged at opposite sides of said mounting plate, wherein the arrangement is formed by interlocking engagement of tabs and grooves in adjacently arranged containers; and an urn for holding the human remains, said urn being received through said opening of said enclosure.

2. A storage container as defined in claim 1, further comprising a plug configured to removably enclose said opening.

3. A storage container as defined in claim 1, further comprising a face plate for attachment to said mounting plate to cover said opening.

4. A storage container as defined in claim 1, wherein said mounting plate is shaped to form a polygon having an even number of sides.

5. A modular storage container for human remains configured to allow a plurality of the containers to be connected to form an arrangement, said container comprising:

a first mounting plate having a perimeter, a thickness and opposite inner and outer surfaces, said perimeter and said thickness defining a first mating surface;

a second mounting plate having a perimeter, a thickness and opposite inner and outer surfaces, said perimeter and said thickness defining a second mating surface;

an urn for holding the human remains; and a tube defining a bore and having opposite first and second axial ends, said tube being attached at said first axial end to said inner surface of said first mounting plate and attached at said second axial end to said inner surface of said second mounting plate with at least one of said first mounting plate and said second mounting plate being formed with an opening that is in communication with said bore to allow said urn to be placed within said bore; and wherein said first mating surface and said second mating surface are configured to allow the plurality of containers to be connected together at said respective first mating surface and said second mating surface to form the arrangement.

6. A storage container as defined in claim 5, wherein said inner surface of said first mounting plate is substantially orthogonally aligned with a longitudinal axis of said tube.

7. A storage container as defined in claim 5, further comprising a plug configured to removably enclose said opening.

8. A storage container as defined in claim 5, further comprising a face plate for attachment to one of said first mounting plate and said second mounting plate to cover said opening.

9. A storage container as defined in claim 5, wherein said perimeter of said first mounting plate is shaped to form a rectangle and wherein said first mating surface includes first and second sides formed with a tab and third and fourth sides formed with a groove dimensioned for receiving a tab from another container in a mating relationship.

10. A storage container as defined in claim 9, wherein said perimeter of said second mounting plate is shaped to form a rectangle and wherein said second mating surface includes first and second sides formed with a tab and third and fourth sides formed with a groove dimensioned for receiving a tab from another container in a mating relationship.

11. A columbarium system for storage of human remains comprising:

a plurality of urns for holding the human remains;

a first wall having opposite inner and outer surfaces;

a second wall having opposite inner and outer surfaces; and a plurality of tubes, each of said tubes defining a bore and having opposite first and second axial ends, said tube being attached at said first axial end to said inner surface of said first wall and attached at said second axial end to said inner surface of said second wall; and wherein at least one of said first wall and said second wall is formed with a plurality of openings, each of said openings being in communication with said bore of one of said plurality of tubes to allow at least one of said plurality of urns to be placed within said bore.

12. A columbarium system as defined in claim 11, wherein said first wall comprises a plurality of first mounting plates, each of said first mounting plates having a first mating surface that is configured to allow said plurality of first mounting plates to be connected together at said first mating surface to form said first wall.

13. A columbarium system as defined in claim 12, wherein said second wall comprises a plurality of second mounting plates, each of said second mounting plates having a second mating surface that is configured to allow said plurality of second mounting plates to be connected together at said second mating surface to form said second wall.

14. A modular storage container for human remains configured to allow a plurality of the containers to be connected to form an arrangement, said container comprising:

walls defining an enclosure having an opening at one end and defining a rim therearound; and a mounting plate mechanically connected to said rim of said enclosure, said mounting plate having:

a thickness;

a polygon shape with an even number of sides, said sides including a first side having a first length and a second side having a second length, said first and second sides being opposite sides;

a first tab arranged at said first side and having a length that is at least half said first length;

a second tab arranged at said second side and having a length that is at least half said second length;

a pair of receiving grooves arranged at opposite sides and dimensioned for receiving one of said tabs therein, wherein the arrangement is formed by interlocking engagement of tabs and grooves in adjacently arranged containers.

15. A storage container as defined in claim 14, wherein said polygon shape of said mounting plate is rectangular.

16. A storage container as defined in claim 15, wherein said first and second tabs are substantially trapezoidal shaped.

17. A method of fabricating a columbarium comprising the steps of:

(a) providing a plurality of storage containers, each of said containers comprising:

a first mounting plate having a perimeter, a thickness and opposite inner and outer surfaces, said perimeter having a polygon shape with said perimeter and said thickness defining a first mating surface;

a second mounting plate having a perimeter, a thickness and opposite inner and outer surfaces, said perimeter having a polygon shape with said perimeter and said thickness defining a second mating surface; and a tube defining a bore and having opposite first and second axial ends, said tube being attach ed at said first axial end to said inner surface of said first mounting plate and attached at said second axial end to said inner surface of said second mounting plate with at least one of said first mounting plate and said second mounting plate being formed with an opening that is in communication with said bore to allow the human remains to be placed within said bore; and wherein said first mating surface and said second mating surface are configured to allow the plurality of containers to be directly connected together at said respective first mating surface and said second mating surface to form the arrangement; and (b) connecting said plurality of containers together at said respective first mating surface and said second mating surface to form the columbarium.

18. A method of fabricating a columbarium as defined in claim 17, wherein said plurality of containers are connected together by applying glue to said first mating surface and said second mating surface.

19. A method of fabricating a columbarium as defined in claim 17, wherein said plurality of containers are connected together by installing mechanical fasteners through said first mounting plate and said second mounting plate.

20. A columbarium system for storage of human remains comprising:

a plurality of containers connected to form an arrangement, each of said plurality of containers including:

a first mounting plate having a perimeter, a thickness and opposite inner and outer surfaces, said perimeter having a polygon shape with said perimeter and said thickness defining a first mating surface;

a second mounting plate having a perimeter, a thickness and opposite inner and outer surfaces, said perimeter having a polygon shape with said perimeter and said thickness defining a second mating surface; and a tube defining a bore and having opposite first and second axial ends, said tube being attached at said first axial end to said inner surface of said first mounting plate and attached at said second axial end to said inner surface of said second mounting plate with at least one of said first mounting plate and said second mounting plate being formed with an opening that is in communication with said bore to allow the human remains to be placed within said bore; and wherein said first mating surface and said second mating surface are configured to allow said plurality of containers to be directly connected together at said respective first mating surface and said second mating surface to form the arrangement.

21. A columbarium system as defined in claim 20, wherein said polygon shape of said first mounting plate is rectangular and wherein said first mating surface includes first and second sides formed with a tab and third and fourth sides formed with a groove dimensioned for receiving a tab from another container in a mating relationship.

22. A columbarium system as defined in claim 21, wherein said polygon shape of said second mounting plate is shaped to form a rectangle and wherein said second mating surface includes first and second sides formed with a tab and third and fourth sides formed with a groove dimensioned for receiving a tab from another container in a mating relationship.

* * * * *